US009143856B2

(12) United States Patent
Herre et al.

(10) Patent No.: US 9,143,856 B2
(45) Date of Patent: Sep. 22, 2015

(54) APPARATUS AND METHOD FOR SPATIALLY SELECTIVE SOUND ACQUISITION BY ACOUSTIC TRIANGULATION

(71) Applicants: Fraunhofer-Gesellschaft zur Foerderung der angewandten Forschung e.V., Munich (DE); Friedrich-Alexander-Universitaet Erlangen-Nuernberg, Buckenhof (DE)

(72) Inventors: Juergen Herre, Buckenhof (DE); Fabian Kuech, Erlangen (DE); Markus Kallinger, Erlangen (DE); Giovanni Del Galdo, Martinroda (DE); Bernhard Grill, Lauf (DE)

(73) Assignees: Fraunhofer-Gesellschaft zur Foerderung der angewandten Forschung e.V., Munich (DE); Friedrich-Alexander-Universitaet Erlangen-Nuernberg, Erlangen (DE)

( * ) Notice: Subject to any disclaimer, the term of this patent is extended or adjusted under 35 U.S.C. 154(b) by 146 days.

(21) Appl. No.: 13/904,857

(22) Filed: May 29, 2013

(65) Prior Publication Data

US 2013/0258813 A1 Oct. 3, 2013

Related U.S. Application Data

(63) Continuation of application No. PCT/EP2011/071600, filed on Dec. 2, 2011.

(60) Provisional application No. 61/419,720, filed on Dec. 3, 2010.

(51) Int. Cl.

| | |
|---|---|
| ***H04R 1/40*** | (2006.01) |
| ***H04R 3/00*** | (2006.01) |
| *G10L 21/0216* | (2013.01) |

(52) U.S. Cl.

CPC ..... *H04R 1/40* (2013.01); *H04R 1/406* (2013.01); *H04R 3/005* (2013.01); *G10L 2021/02166* (2013.01); *H04R 2201/401* (2013.01); *H04R 2430/25* (2013.01)

(58) Field of Classification Search

CPC ..... H04R 1/406; H04R 3/005; H04R 1/40; H04R 2201/401; H04R 2430/25; G10L 2021/02166

USPC ..... 367/135

See application file for complete search history.

(56) References Cited

U.S. PATENT DOCUMENTS

| | | | | |
|---|---|---|---|---|
| 2004/0193430 | A1 | 9/2004 | Park et al. | |
| 2007/0047742 | A1 * | 3/2007 | Taenzer et al. | 381/92 |

(Continued)

FOREIGN PATENT DOCUMENTS

| | | | |
|---|---|---|---|
| CN | 101843118 | A | 9/2010 |
| EP | 2154677 | A1 | 2/2010 |

(Continued)

OTHER PUBLICATIONS

Chien, et al., "Car Speech Enhancement Using Microphone Array Beamforming and Post Filters", Proc. of the 9th Int'l Conf. on Speech Science & Technology, Melbourne, Dec. 2002, pp. 568-573.

(Continued)

*Primary Examiner* — Daniel Pihulic

(74) *Attorney, Agent, or Firm* — Perkins Coie LLP; Michael A. Glenn

(57) ABSTRACT

An apparatus for capturing audio information from a target location includes first and second beamformers arranged in a recording environment and having first and second recording characteristics, respectively, and a signal generator. The first and second beamformers are configured for recording first and second beamformer audio signals, respectively, when they are directed towards the target location with respect to the first and second recording characteristics. The first and second beamformers are arranged such that first and second virtual straight lines, defined to pass through the first and second beamformers, respectively, and the target location, are not mutually parallel. The signal generator is configured to generate an audio output signal based on the first and second beamformer audio signals so that the audio output signal reflects relatively more audio information from the target location compared to the audio information from the target location in the first and second beamformer audio signals.

13 Claims, 10 Drawing Sheets

(56) References Cited

U.S. PATENT DOCUMENTS

| | | | | |
|---|---|---|---|---|
| 2008/0260175 | A1 | 10/2008 | Elko | |
| 2010/0014690 | A1 | 1/2010 | Wolff et al. | |
| 2010/0278366 | A1 | 11/2010 | Biundo Lotito et al. | |
| 2013/0258813 | A1 * | 10/2013 | Herre et al. | 367/135 |

FOREIGN PATENT DOCUMENTS

| | | | |
|---|---|---|---|
| JP | 11-024690 | | 1/1999 |
| JP | 2001-204092 | | 1/2001 |
| JP | 2004-289762 | | 10/2004 |
| JP | 2009-135594 | | 6/2009 |
| RU | 2315371 | C2 | 1/2008 |
| WO | WO-2006006935 | | 1/2006 |
| WO | WO-2007025033 | | 3/2007 |

OTHER PUBLICATIONS

Faller, et al., "Obtaining a Highly Directive Center Channel from Coincident Stereo Microphone Signals", AES Convention Paper 7380, Presented at the 124th Convention, Amsterdam, The Netherlands, May 2008, 7 pages.

Marro, et al., "Analysis of Noise Reduction and Derverberation Techniques Based on Microphone Arrays with Postfiltering", IEEE Transactions on Speech and Audio Processing, vol. 6 No. 3, New York, May 1998, pp. 240-259.

Simmer, et al., "Time Delay Compensation for Adaptive Multichannel Speech Enhancement Systems", Proc. of ISSSE-92, Paris, Sep. 1992, 4 pages.

Bitzer, J. et al., "Superdirective Microphone Arrays", Brandstein, M., Ward, D., Edition: Microphone Arrays—Signal Processing Techniques and Applications, Springer Berlin, 2001, Chapter 2, pp. 19-38; ISBN: 978-3-540-41953-2.

Chen, J. et al., "Time Delay Estimation in Room Acoustic Environments: An Overview", EURASIP Journal on Applied Signal Processing, vol. 2006, Article 26503, pp. 1-19., 2006.

Eargle, J. , "The Pressure Microphone", The Microphone Book, Focal Press Chapter 3, pp. 22-25, 2001.

Elko, G.W., "Superdirectional Microphone Arrays", Editors: S.L. Gay and J. Benesty; Acoustic Signal Processing for Telecommunication; Kluwer Academic Publishers, Norwell, MA; Chapter 10, pp. 181-235, 2000.

Faller, et al., "Binaural Cue Coding—Part II: Schemes and Applications", IEEE Transactions on Speech and Audio Processing, vol. 11, No. 6, pp. 520-531, Nov. 2003.

Faller, Christof, "Parametric Multichannel Audio Coding: Synthesis of Coherence Cues", IEEE Trans. on Speech and Audio Proc., vol. 14, No. 1, pp. 299-310, Jan. 2006.

Greenberg, J. et al., "Microphone Array Hearing Aids", In M. Brandstein, D. Ward: "Microphone Arrays—Signal Processing Techniques and Applications", Springer Berlin, Part 3, Chapter 11, pp. 229-253, 2001, ISBN: 978-3-540-41953-2.

Herre, J. et al., "Mpeg Surround—The ISO/MPEG Standard for Efficient and Compatible Multichannel Audio Coding", J. Audio Eng. Soc., vol. 56, No. 11, pp. 932-955, Nov. 2008.

Kallinger, Markus et al., "Spatial filtering using directional audio coding parameters", Acoustics, Speech and Signal Processing, XP031459205, Spatial Filtering using Directional Audio Coding Parameters, in Proc. IEEE Int. Conf. on Acoustics, Speech, and Signal Processing (ICASSP), pp. 217-220, Apr. 19, 2009.

Pulkki, V., "Directional audio coding in spatial sound reproduction and stereo upmixing," in Proceedings of the AES 28th International Conference, pp. 251-258, Piteå, Sweden, Jun. 30-Jul. 2, 2006.

Simmer, K. U. et al., "Post-Filtering Techniques", Springer Berlin, In M. Brandstein, D. Ward Enistion: Microphone Arrays—Signal Processing Techniques and Applications; Chapter 3; pp. 39-60, 2001, ISBN: 978-540-41953-2.

Veen, B.D.V. et al., "Beamforming: A versatile approach to spatial filtering", IEEE ASSP Magazine, pp. 4-24, Apr. 1988.

Villemoes, L. et al., "MPEG surround: The forthcoming ISO standard for spatial audio coding", in AES 28th International Conference, The Future of Audio Technology Surround and Beyond, pp. 1-18, Pitea, SE, Jul. 2, 2006.

* cited by examiner

APPARATUS AND METHOD FOR SPATIALLY SELECTIVE SOUND ACQUISITION BY ACOUSTIC TRIANGULATION

CROSS-REFERENCE TO RELATED APPLICATIONS

This application is a continuation of copending International Application No. PCT/EP2011/071600, filed Dec. 2, 2011, which is incorporated herein by reference in its entirety, and additionally claims priority from U.S. Application No. 61/419,720, filed Dec. 3, 2010, which is also incorporated herein by reference in its entirety.

The invention relates to audio processing and in particular to an apparatus for capturing audio information from a target location. Moreover, the application relates to spatially selective sound acquisition by acoustic triangulation.

BACKGROUND OF THE INVENTION

Spatial sound acquisition aims at capturing an entire sound field which is present at a recording room or just certain desired components of the sound field that are of interest for the application at hand. As an example, in a situation where several people in a room have a conversation, it may be of interest to either capture the entire sound field (including its spatial characteristics) or just a signal that a certain talker produces. The latter enables to isolate the sound and apply specific processing to it, such as amplification, filtering etc.

There are a number of methods known for spatially selectively capturing certain sound components. These methods often employ microphones with a high directionality or microphone arrays. Most methods have in common that the microphone or the microphone array is arranged in a fixed known geometry. The spacing between the microphones is as small as possible for coincident microphone techniques, whereas it is normally a few centimeters for the other methods. In the following, we refer to any apparatus for the directionally selective acquisition of the spatial sound (e.g., directional microphones, microphone arrays, etc.) as a beamformer.

Traditionally, directional (spatial) selectivity in sound capture, i.e., a spatially selective sound acquisition, can be achieved in several ways:

One possible way is to employ directional microphones (e.g., cardioid, super cardioid, or shot gun microphones). There, all microphones capture the sound differently depending on the direction-of-arrival (DOA) relative to the microphone. In some microphones, this effect is minor, as they capture sound almost independently of the direction. These microphones are called omnidirectional microphones. Typically in such microphones, a circular diaphragm is attached to a small airtight enclosure, see, for example,

[Ea01] Eargle J. "The Microphone Book" Focal press 2001.

If the diaphragm is not attached to the enclosure and sound reaches it equally from each side, its directional pattern has two lobes of equal magnitude. It captures sound with equal level from both front and back of the diaphragm, however, with inversed polarities. This microphone does not capture sound coming from the directions parallel to the plane of the diaphragm. This directional pattern is called dipole or figure-of-eight. If the enclosure of omnidirectional microphone is not airtight, but a special construction is made, which allows the sound waves to propagate through the enclosure and reach the diaphragm, the directional pattern is somewhere between omnidirectional and dipole (see [Ea01]). The patterns may have two lobes; however, the lobes may have different magnitudes. The patterns may also have a single lobe; the most important example is the cardioid pattern, where the directional function D can be expressed as $D=0.5(1+\cos(\theta))$, where $\theta$ is the direction of arrival of sound (see [Ea01]). This function quantifies the relative magnitude of the captured sound level of a plane wave at the angle $\theta$ with respect to the angle with the highest sensitivity. Omnidirectional microphones are called zeroth-order microphones and other patterns mentioned in the previous, such as dipole and cardioid patterns, are known as first-order patterns. These kinds of microphones do not allow arbitrary shaping of the pattern since their directivity pattern is almost entirely determined by their mechanical construction.

Some special acoustical structures also exist which can be used to create narrower directional patterns to microphones than first-order ones. For example, if a tube which has holes in it is attached to an omnidirectional microphone, a microphone with a very narrow directional pattern can be created. Such microphones are called shotgun or rifle microphones (see [Ea01]). They typically do not have flat frequency responses and their directivity cannot be controlled after recording.

Another method to construct a microphone with directional characteristics is to record sound with an array of omnidirectional or directional microphones and to apply signal processing afterwards, see, for example,

[BW01] M. Brandstein, D. Ward: "Microphone Arrays—Signal Processing Techniques and Applications", Springer Berlin, 2001, ISBN: 978-3-540-41953-2.

There exist a variety of methods for this. In simplest form, when sound is recorded with two omnidirectional microphones close to each other and subtracted from each other, a virtual microphone signal with a dipole characteristic is formed. See, e.g.

[Elk00] G. W. Elko: "Superdirectional microphone arrays" in S. G. Gay, J. Benesty (eds.): "Acoustic Signal Processing for Telecommunication", Chapter 10, Kluwer Academic Press, 2000, ISBN: 978-0792378143.

The microphone signals can also be delayed or filtered before summing to each other. In beamforming, a signal corresponding to a narrow beam is formed by filtering each microphone signal with a specially designed filter and then adding them together. This "filter-and-sum beamforming" is explained in

[BS01]: J. Bitzer, K. U. Simmer: "Superdirective microphone arrays" in M. Brandstein, D. Ward (eds.): "Microphone Arrays—Signal Processing Techniques and Applications", Chapter 2, Springer Berlin, 2001, ISBN: 978-3-540-41953-2.

These techniques are blind to the signal itself, e.g., they are not aware of the direction of arrival of sound. Instead, estimation of the "direction of arrival" (DOA) is a task of its own, see, for example,

[CBH06] J. Chen, J. Benesty, Y. Huang: "Time Delay Estimation in Room Acoustic Environments: An Overview", EURASIP Journal on Applied Signal Processing, Article ID 26503, Volume 2006 (2006).

In principle, many different directional characteristics can be formed with these techniques. For forming arbitrary spatially very selective sensitivity patterns, however, a large number of microphones may be used. In general, all these techniques rely on distances of adjacent microphones which are small compared to the wavelength of interest.

Another way for realizing directional selectivity in sound capture is parametric spatial filtering. Standard beamformer designs, which may, for example, be based on a limited number of microphones and which possess time-invariant filters in their filter-and-sum structure (see [BS01]) usually exhibit only limited spatial selectivity. To increase the spatial selectivity, recently parametric spatial filtering techniques have been proposed which apply (time-variant) spectral gain functions to the input signal spectrum. The gain functions are designed based on parameters, which are related to the human perception of spatial sound. One spatial filtering approach is presented in

[DiFi2009] M. Kallinger, G. Del Galdo, F. Küch, D. Mahne, and R. Schultz-Amling, "Spatial Filtering using Directional Audio Coding Parameters," in Proc. IEEE Int. Conf. on Acoustics, Speech, and Signal Processing (ICASSP), April 2009, and is implemented in the parameters domain of Directional Audio Coding (DirAC), an efficient spatial coding technique. Directional Audio Coding is described in

[Pu106] Pulkki, V., "Directional audio coding in spatial sound reproduction and stereo upmixing," in Proceedings of The AES 28th International Conference, pp. 251-258, PiteA, Sweden, Jun. 30-Jul. 2, 2006.

In DirAC, the sound field is analyzed in one location at which the active intensity vector as well as the sound pressure is measured. These physical quantities are used to extract the three DirAC parameters: sound pressure, direction-of-arrival (DOA) and diffuseness of sound. DirAC makes use of the assumption that the human auditory system can only process one direction per time- and frequency-tile. This assumption is also exploited by other spatial audio coding techniques like MPEG Surround, see, for example:

[Vil06] L. Villemoes, J. Herre, J. Breebaart, G. Hotho, S. Disch, H. Purnhagen, and K. Kjörling, "MPEG Surround: The Forthcoming ISO Standard for Spatial Audio Coding," in AES 28th International Conference, Pitea, Sweden, June 2006.

The spatial filtering approach, as described in [DiFi2009], allows for an almost free choice of spatial selectivity.

A further technique makes use of comparable spatial parameters. This technique is explained in

[Fa108] C. Faller: "Obtaining a Highly Directive Center Channel from Coincident Stereo Microphone Signals", Proc. 124th AES convention, Amsterdam, The Netherlands, 2008, Preprint 7380.

In contrast to the technique described in [DiFi2009], in which a spectral gain function is applied to an omnidirectional microphone signal, the approach in [Fa108] makes use of two cardioid microphones.

The two mentioned parametric spatial filtering techniques rely on microphone spacings, which are small compared to the wavelength of interest. Ideally, the techniques described in [DiFi2009] and [Fa108] are based on coincident directional microphones.

Another way of realizing directional selectivity in sound capture is a filtering of microphone signals based on the coherence between microphone signals. In

[SBM01] K. U. Simmer, J. Bitzer, and C. Marro: "Post-Filtering Techniques" in M. Brandstein, D. Ward (eds.): "Microphone Arrays—Signal Processing Techniques and Applications", Chapter 3, Springer Berlin, 2001, ISBN: 978-3-540-41953-2, a family of systems is described, which employ at least two (not necessarily directional) microphones and a processing of their output signal is based on the coherence of the signals. The underlying assumption is that diffuse background noise will appear as incoherent parts in the two microphone signals, whereas a source signal will appear coherently in these signals. Based on this premise, the coherent part is extracted as source signal. Techniques mentioned in [SBM01] were developed due to the fact that filter-and-sum beamformers with a limited number of microphones are hardly capable of reducing diffuse noise signals. No assumptions on the location of the microphones are made; not even the spacing of microphones needs to be known.

A major limitation of traditional approaches for spatially selective sound acquisition is that the recorded sound is invariably related to the location of the beamformer. In many applications it is, however, not possible (or feasible) to place a beamformer in the desired position, e.g., at a desired angle relative to the sound source of interest.

Traditional beamformers, may, for example, employ microphone arrays and can form a directional pattern ("beam") to capture sound from one direction—and reject sound from other directions. Consequently, there is no possibility to restrict the region of sound capture regarding its distance from the capturing microphone array.

It would be extremely desirable to have a capturing device which can selectively capture sound originating not only from one direction, but directly restricted to originating from one place (spot), similar to the way a close-up spot microphone at the desired place would perform.

SUMMARY

According to an embodiment, an apparatus for capturing audio information from a target location may have: a first beamformer being arranged in a recording environment and having a first recording characteristic, a second beamformer being arranged in the recording environment and having a second recording characteristic, and a signal generator, wherein the first beamformer is configured for recording a first beamformer audio signal when the first beamformer is directed towards the target location with respect to the first recording characteristic, and wherein the second beamformer is configured for recording a second beamformer audio signal when the second beamformer is directed towards the target location with respect to the second recording characteristic, wherein the first beamformer and the second beamformer are arranged such that a first virtual straight line, being defined to pass through the first beamformer and the target location, and a second virtual straight line, being defined to pass through the second beamformer and the target location, are not parallel with respect to each other, and wherein the signal generator is configured to generate an audio output signal based on the first beamformer audio signal and on the second beamformer audio signal, so that the audio output signal has relatively more audio information from the target location compared to the audio information from the target location in the first and the second beamformer audio signal, wherein the signal generator has an intersection calculator for generating the audio output signal in the spectral domain based on the first and second beamformer audio signal, and wherein the intersection calculator is configured to compute the audio output signal in the spectral domain by calculating a cross-spectral density of the first and the second beamformer audio signal, and by calculating a power spectral density of the first or the second beamformer audio signal.

According to another embodiment, a method for computing audio information from a target location may have the steps of recording a first beamformer audio signal by a first beamformer being arranged in a recording environment and having a first recording characteristic when the first beamformer is directed towards the target location with respect to the first recording characteristic, recording a second beamformer audio signal by a second beamformer being arranged in the recording environment and having a second recording characteristic when the second beamformer is directed towards the target location with respect to the second recording characteristic, generating an audio output signal based on the first beamformer audio signal and on the second beamformer audio signal so that the audio output signal has relatively more audio information from the target location compared to the audio information from the target location in the first and the second beamformer audio signal, wherein the first beamformer and the second beamformer are arranged such that a first virtual straight line, being defined to pass through the first beamformer and the target location and a second virtual straight line, being defined to pass through the second beamformer and the target location, are not parallel with respect to each other, wherein the audio output signal is generated in the spectral domain by calculating the first and second beamformer audio signal, and wherein the audio output signal is computed in the spectral domain by calculating a cross-spectral density of the first and the second beamformer audio signal, and by calculating a power spectral density of the first or the second beamformer audio signal.

Another embodiment may have a computer program for implementing the method for computing audio information from a target location, may have the steps of: recording a first beamformer audio signal by a first beamformer being arranged in a recording environment and having a first recording characteristic when the first beamformer is directed towards the target location with respect to the first recording characteristic, recording a second beamformer audio signal by a second beamformer being arranged in the recording environment and having a second recording characteristic when the second beamformer is directed towards the target location with respect to the second recording characteristic, generating an audio output signal based on the first beamformer audio signal and on the second beamformer audio signal so that the audio output signal has relatively more audio information from the target location compared to the audio information from the target location in the first and the second beamformer audio signal, wherein the first beamformer and the second beamformer are arranged such that a first virtual straight line, being defined to pass through the first beamformer and the target location and a second virtual straight line, being defined to pass through the second beamformer and the target location, are not parallel with respect to each other, wherein the audio output signal is generated in the spectral domain by calculating the first and second beamformer audio signal, and wherein the audio output signal is computed in the spectral domain by calculating a cross-spectral density of the first and the second beamformer audio signal, and by calculating a power spectral density of the first or the second beamformer audio signal, when the computer program is executed by a computer or processor.

An apparatus for capturing audio information from a target location is provided. The apparatus comprises a first beamformer being arranged in a recording environment and having a first recording characteristic, a second beamformer being arranged in the recording environment and having a second recording characteristic and a signal generator. The first beamformer is configured for recording a first beamformer audio signal and the second beamformer is configured for recording a second beamformer audio signal when the first beamformer and the second beamformer are directed towards the target location with respect to the first and second recording characteristic. The first beamformer and the second beamformer are arranged such that a first virtual straight line, being defined to pass through the first beamformer and the target location, and a second virtual straight line, being defined to pass through the second beamformer and the target location, are not parallel with respect to each other. The signal generator is configured to generate an audio output signal based on the first beamformer audio signal and on the second beamformer audio signal so that the audio output signal reflects relatively more audio information from the target location compared to the audio information from the target location in the first and second beamformer audio signal. With respect to a three-dimensional environment, advantageously, the first virtual straight line and the second virtual straight line intersect and define a plane that can be arbitrarily oriented.

By this, means to capture sound in a spatially selective way are provided, i.e., pick up sound originating from a specific target location just as if a close-up "spot microphone" had been installed at this location. Instead of really installing this spot microphone, however, its output signal can be simulated by using two beamformers placed at different distant positions.

These two beamformers are not positioned closely to each other but they are located such that each of them performs an independent directional sound acquisition. Their "beams" overlap at a desired spot and their individual outputs are subsequently combined to form a final output signal. In contrast to other possible approaches, the combination of the two individual outputs does not require any information or knowledge about the position of the two beamformers in a common coordinate system. Thus, the entire setup for virtual spot microphone acquisition comprises two beamformers that operate independently, plus a signal processor which combines both individual output signals into the signal of the remote "spot microphone".

In an embodiment, the apparatus comprises a first and a second beamformer, e.g., two spatial microphones and a signal generator, e.g., a combination unit, e.g. a processor, for realizing "acoustic intersection". Each spatial microphone has a clear directional selectivity, i.e., it attenuates sound originating from locations outside its beam as compared to sound originating from a location inside its beam. The spatial microphones operate independently from each other. The location of the two spatial microphones, also flexible by nature, is chosen such that the target spatial location is located in the geometric intersection of the two beams. In an advantageous embodiment, the two spatial microphones form an angle of around 90 degrees with respect to the target location. The combination unit, e.g. the processor, may be unaware of the geometric location of the two spatial microphones or the location of the target source.

According to an embodiment, the first beamformer and the second beamformer are arranged with respect to the target location such that the first virtual straight line and the second virtual straight line cross each other, and such that they intersect in the target location with an angle of intersection between 30 degrees and 150 degrees. In a further embodiment, the angle of intersection is between 60 degrees and 120 degrees. In an advantageous embodiment, the angle of intersection is about 90 degrees.

In an embodiment, the signal generator comprises an adaptive filter having a plurality of filter coefficients. The adaptive filter is arranged to receive the first beamformer audio signal. The filter is adapted to modify the first beamformer audio signal depending on the filter coefficients to obtain a filtered first beamformer audio signal. The signal generator is configured to adjust the filter coefficients of the filter depending on the second beamformer audio signal. The signal generator may be configured to adjust the filter coefficients such that the difference between the filtered first beamformer audio signal and the second beamformer second audio signal is minimized.

In an embodiment, the signal generator comprises an intersection calculator for generating the audio output signal in the spectral domain based on the first and second beamformer audio signal. According to an embodiment, the signal generator may further comprise an analysis filterbank for transforming the first and the second beamformer audio signal from a time domain to a spectral domain, and a synthesis filterbank for transforming the audio output signal from a spectral domain to a time domain. The intersection calculator may be configured to calculate the audio output signal in the spectral domain based on the first beamformer audio signal being represented in the spectral domain and on the second beamformer audio signal being represented in the spectral domain.

In a further embodiment, the intersection calculator is configured to compute the audio output signal in the spectral domain based on a cross-spectral density of the first and the second beamformer audio signal, and based on a power spectral density of the first or the second beamformer audio signal.

According to an embodiment, the intersection calculator is configured to compute the audio output signal in the spectral domain by employing the formula $$Y_1(k, n) = S_1(k, n) \cdot G_1(k, n), \text{ with } G_1(k, n) = \sqrt{\frac{C_{12}(k, n)}{P_1(k, n)}}$$

wherein $Y_1(k, n)$ is the audio output signal in the spectral domain, wherein $S_1(k, n)$ is the first beamformer audio signal, wherein $C_{12}(k, n)$ is a cross-spectral density of the first and the second beamformer audio signal, and wherein $P_1(k, n)$ is a power spectral density of the first beamformer audio signal, or by employing the formula $$Y_2(k, n) = S_2(k, n) \cdot G_2(k, n),$$

$$\text{with } G_2(k, n) = \sqrt{\frac{C_{12}(k, n)}{P_2(k, n)}}$$

wherein $Y_2(k, n)$ is the audio output signal in the spectral domain, wherein $S_2(k, n)$ is the second beamformer audio signal, wherein $C_{12}(k, n)$ is a cross-spectral density of the first and the second beamformer audio signal, and wherein $P_2(k, n)$ is a power spectral density of the second beamformer audio signal.

In another embodiment, the intersection calculator is adapted to calculate both the signal $Y_1(k, n)$ and $Y_2(k, n)$ and to select the smaller of both signals as the audio output signal.

In another embodiment, the intersection calculator is configured to compute the audio output signal in the spectral domain by employing the formula $$Y_3(k, n) = S_1 \cdot G_{34}(k, n),$$

$$\text{with } G_{34}(k, n) = \sqrt{\frac{C_{12}(k, n)}{0.5(P_1(k, n) + P_2(k, n))}}$$

wherein $Y_3(k, n)$ is the audio output signal in the spectral domain, wherein $S_1$ is the first beamformer audio signal, wherein $C_{12}(k, n)$ is a cross-spectral density of the first beamformer audio signal, wherein $P_1(k, n)$ is a power spectral density of the first beamformer audio signal, and wherein $P_2(k, n)$ is a power spectral density of the second beamformer audio signal, or by employing the formula $$Y_4(k, n) = S_2 \cdot G_{34}(k, n),$$

$$\text{with } G_{34}(k, n) = \sqrt{\frac{C_{12}(k, n)}{0.5(P_1(k, n) + P_2(k, n))}}$$

wherein $Y_4(k, n)$ is the audio output signal in the spectral domain, wherein $S_2$ is the second beamformer audio signal, wherein $C_{12}(k, n)$ is a cross-spectral density of the first and the second beamformer audio signal, wherein $P_1(k, n)$ is a power spectral density of the first beamformer audio signal, and wherein $P_2(k, n)$ is a power spectral density of the second beamformer audio signal.

In another embodiment, the intersection calculator may be adapted to calculate both the signal $Y_3(k, n)$ and $Y_4(k, n)$ and to select the smaller of both signals as the audio output signal.

According to another embodiment, the signal generator may be adapted to generate the audio output signal by combining the first and the second beamformer audio signal to obtain a combined signal and by weighting the combined signal by a gain factor. The combined signal may, for example, be weighted in a time domain, in a subband domain or in a Fast Fourier Transform domain.

In a further embodiment, the signal generator is adapted to generate the audio output signal by generating a combined signal such that the power spectral density value of the combined signal is equal to the minimum of the power spectral density value of the first and the second beamformer audio signal for each considered time-frequency tile.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
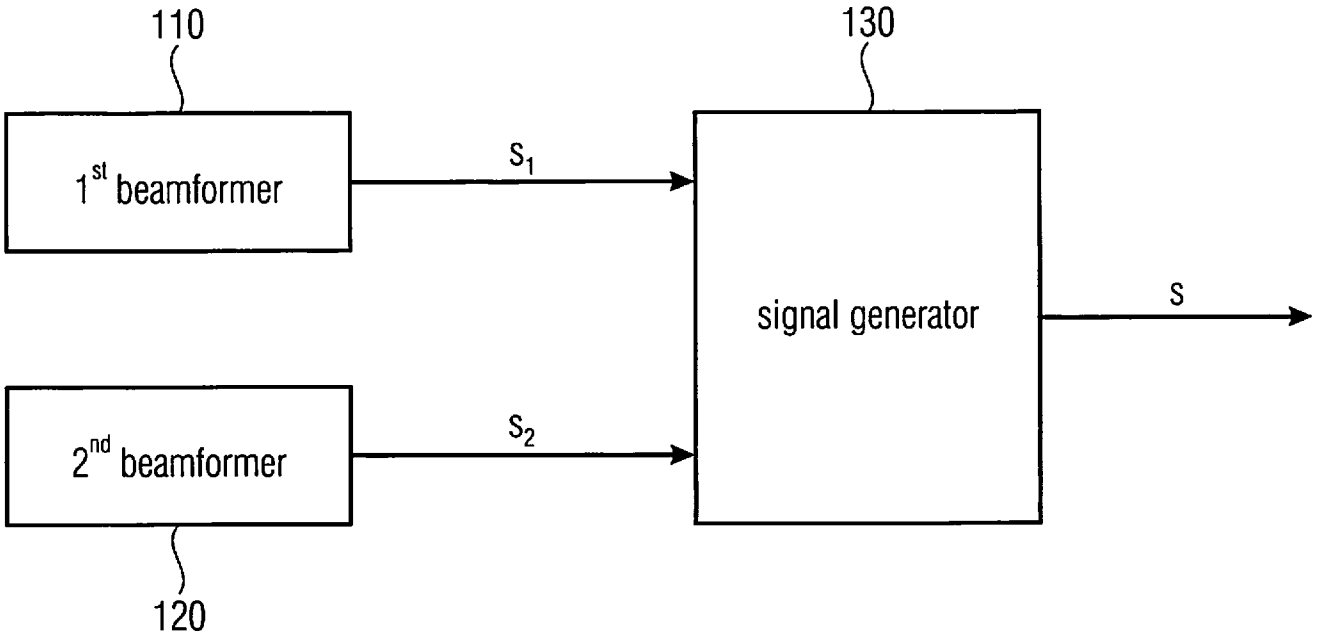
FIG. 1 illustrates an apparatus for capturing audio information from a target location according to an embodiment.

FIG. 1 illustrates an apparatus for capturing audio information from a target location. The apparatus comprises a first beamformer 110 being arranged in a recording environment and having a first recording characteristic. Moreover, the apparatus comprises a second beamformer 120 being arranged in the recording environment and having a second recording characteristic. Furthermore, the apparatus comprises a signal generator 130. The first beamformer 110 is configured for recording a first beamformer audio signal $s_1$ when the first beamformer 110 is directed towards the target location with respect to the first recording characteristic. The second beamformer 120 is configured for recording a second beamformer audio signal $s_2$ when the second beamformer 120 is directed towards the target location with respect to the second recording characteristic. The first beamformer 110 and the second beamformer 120 are arranged such that a first virtual straight line, being defined to pass through the first beamformer 110 and the target location, and a second virtual straight line, being defined to pass through the second beamformer 120 and the target location, are not parallel with respect to each other. The signal generator 130 is configured to generate an audio output signal s based on the first beamformer audio signal $s_1$ and on the second beamformer audio signal $s_2$, so that the audio output signal s reflects relatively more audio information from the target location compared to the audio information from the target location in the first and second beamformer audio signal $s_1$, $s_2$.

Figure 2:
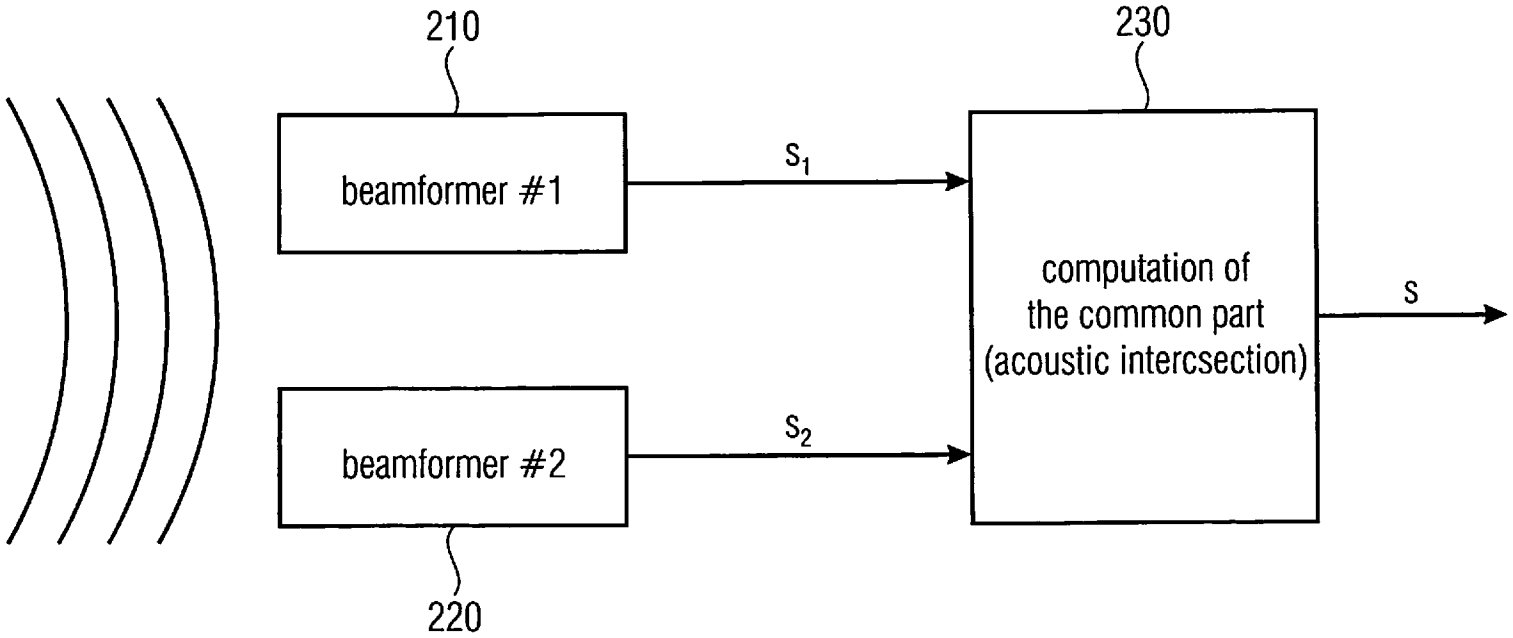
FIG. 2 illustrates an apparatus according to an embodiment using two beamformers and a stage for computing the output signal.

FIG. 2 illustrates an apparatus according to an embodiment using two beamformers and a stage for computing the output signal as the common part of the two beamformer individual output signals. A first beamformer 210 and a second beamformer 220 for recording a first and a second beamformer audio signal, respectively, are depicted. A signal generator 230 realizes the computation of the common signal part (an "acoustic intersection").

Figure 3A:
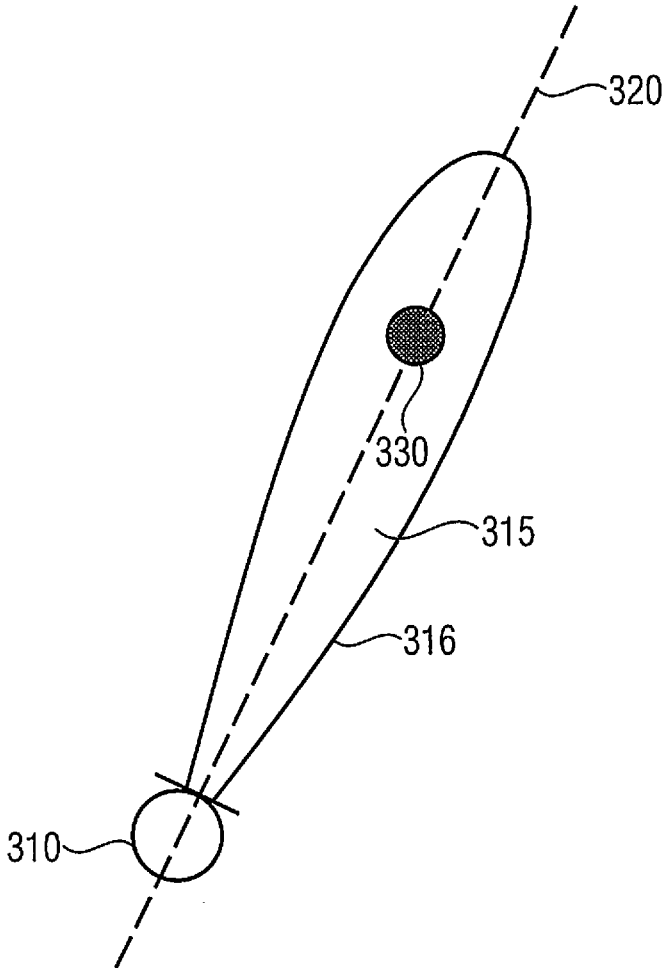
FIG. 3*a* illustrates a beamformer and a beam of the beamformer being directed towards a target location.

FIG. 3*a* illustrates a beamformer 310. The beamformer 310 of the embodiment of FIG. 3*a* is an apparatus for directionally selective acquisition of spatial sound. For example, the beamformer 310 may be a directional microphone or a microphone array. In another embodiment, the beamformer may comprise a plurality of directional microphones.

FIG. 3*a* illustrates a curved line 316 that encloses a beam 315. All points on the curved line 316 that defines the beam 315 are characterized in that a predefined sound pressure level originating from a point on the curved line results in the same signal level output of the microphone for all points on the curved line.

Moreover, FIG. 3*a* illustrates a major axis 320 of the beamformer. The major axis 320 of the beamformer 310 is defined in that a sound with a predefined sound pressure level originating from a considered point on the major axis 320 results in a first signal level output in the beamformer that is greater than or equal to a second signal level output of the beamformer resulting from a sound with the predefined sound pressure level originating from any other point having the same distance from the beamformer as the considered point.

Figure 3B:
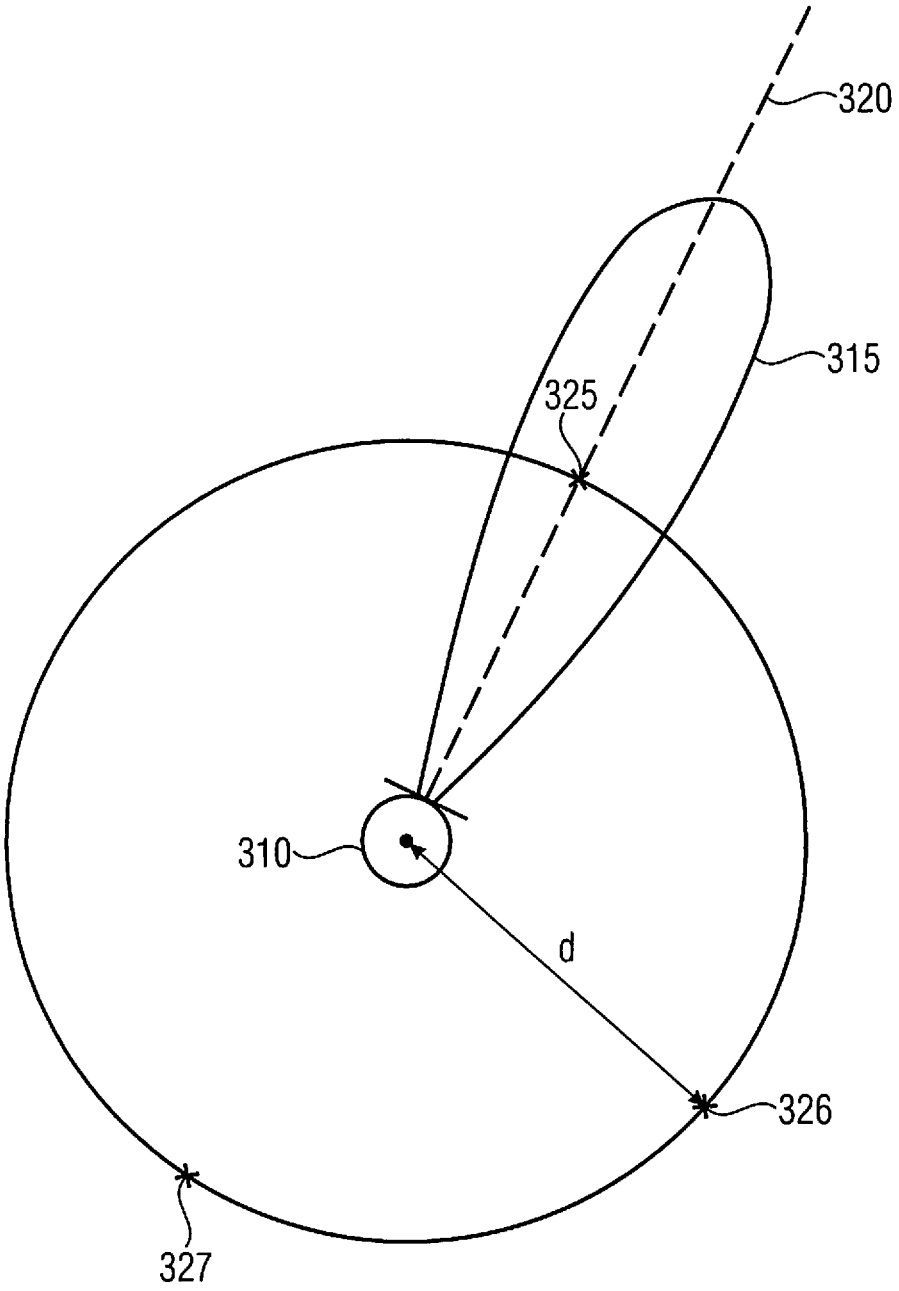
FIG. 3*b* illustrates a beamformer and a beam of the beamformer showing further details.

FIG. 3*b* illustrates this in more detail. The points 325, 326 and 327 have equal distance d from the beamformer 310. A sound with a predefined sound pressure level originating from the point 325 on the major axis 320 results in a first signal level output in the beamformer that is greater than or equal to a second signal level output of the beamformer resulting from a sound with the predefined sound pressure level originating from, for example, point 326 or point 327, which have the same distance d from the beamformer 310 as the point 325 on the major axis. In the three-dimensional case, this means, that the major axis indicates the point on a virtual ball with the beamformer located in the center of the ball, which generates the greatest signal level output in the beamformer when a predefined sound pressure level originates from the point compared with any other point on the virtual ball.

Returning to FIG. 3*a*, there is also depicted a target location 330. The target location 330 may be a location from which sounds originate that a user intends to record using the beamformer 310. For this, the beamformer may be directed to the target location to record the desired sound. In this context, a beamformer 310 is considered to be directed to a target location 330, when the major axis 320 of the beamformer 310 passes through the target location 330. Sometimes, the target location 330 may be a target area while in other examples, the target location may be a point. If the target location 330 is a point, the major axis 320 is considered to pass through the target location 330, when the point is located on the major axis 320. In FIG. 3, the major axis 320 of the beamformer 310 passes through the target location 330, and therefore, the beamformer 310 is directed to the target location.

The beamformer 310 has a recording characteristic that indicates the ability of the beamformer to record sound depending on the direction the sound originates from. The recording characteristic of the beamformer 310 comprises the direction of the major axis 320 in space, the direction, form and properties of the beam 315, etc.

Figure 4A:
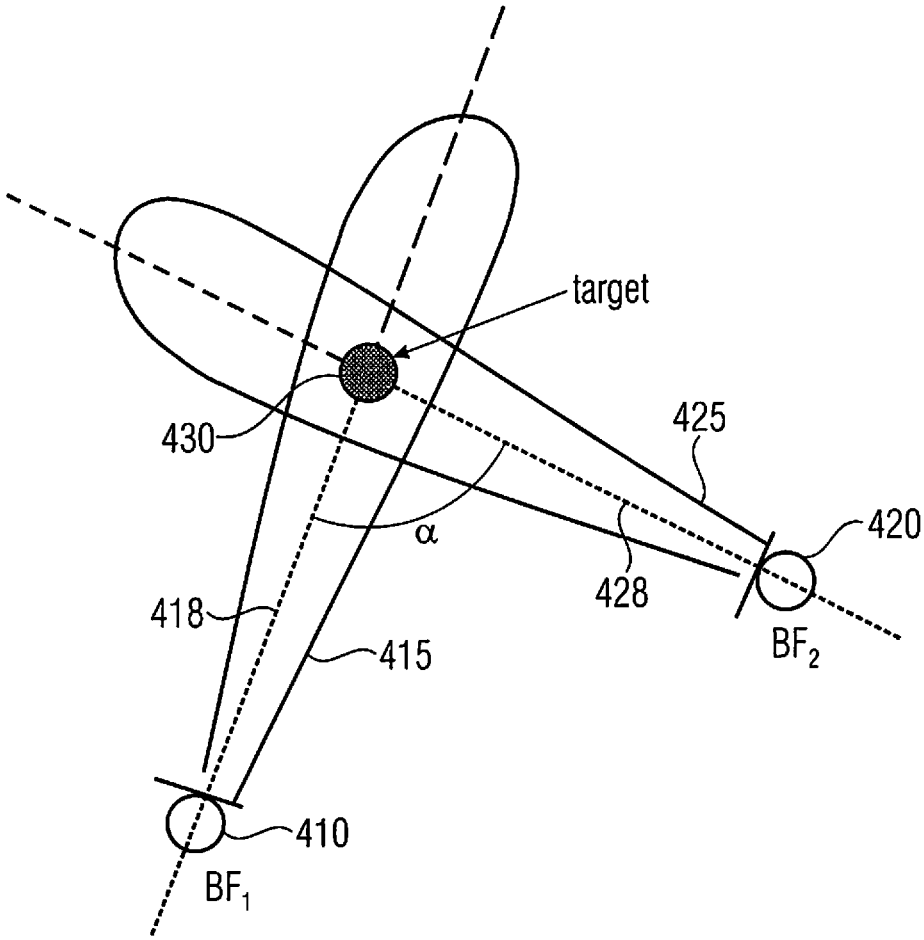
FIG. 4*a* illustrates a geometric setup of two beamformers with respect to a target location according to an embodiment.

FIG. 4*a* illustrates a geometric setup of two beamformers, a first beamformer 410 and a second beamformer 420, with respect to a target location 430. A first beam 415 of the first beamformer 410 and a second beam 425 of the second beamformer 420 are illustrated. Moreover, FIG. 4*a* depicts a first major axis 418 of the first beamformer 410 and a second major axis 428 of the second beamformer 420. The first beamformer 410 is arranged such that it is directed to the target location 430, as the first major axis 418 passes through the target location 430. Moreover, the second beamformer 420 is also directed to the target location 430, as the second major axis 428 passes through the target location 430.

The first beam 415 of the first beamformer 410 and the second beam 425 of the second beamformer 420 intersect in the target location 430, where a target source that outputs sound is located. An angle of intersection of the first major axis 418 of the first beamformer 410 and the second major axis 428 of the second beamformer 420 is denoted as $\alpha$. Optimally, the angle of intersection $\alpha$ is 90 degrees. In other embodiments, the angle of intersection is between 30 degrees and 150 degrees.

In a three-dimensional environment, advantageously, the first major axis and the second virtual major axis intersect and define a plane that can be arbitrarily oriented.

Figure 4B:
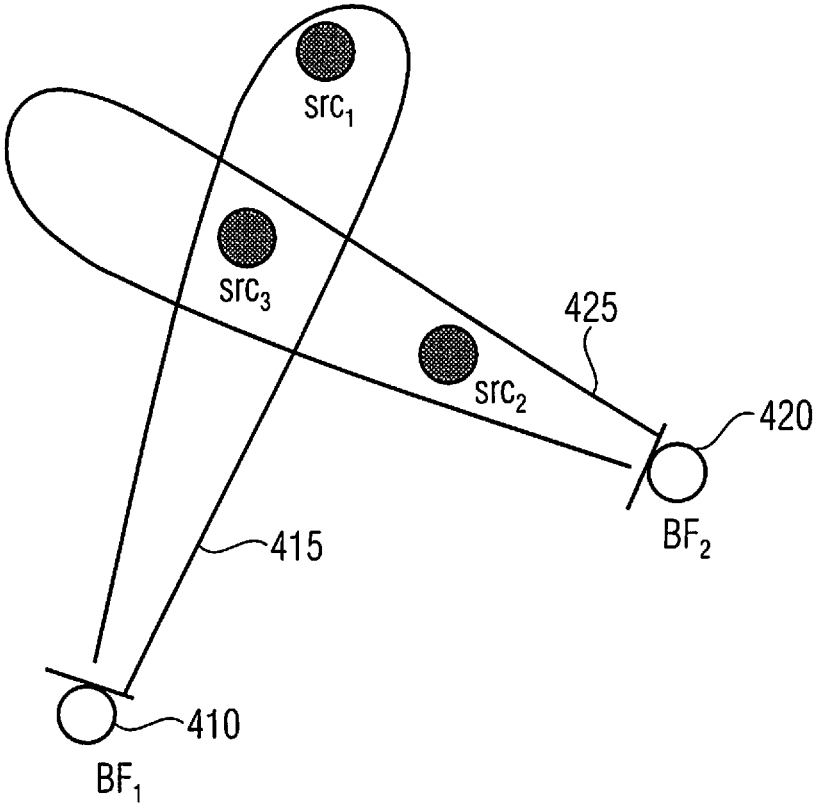
FIG. 4*b* depicts the geometric setup of the two beamformers of FIG. 4*a* and three sound sources.

FIG. 4*b* depicts the geometric setup of the two beamformers of FIG. 4*a*, further illustrating three sound sources src1, src2, src3. The beams 415, 425 of beamformers 410 and 420 intersect in the target location, i.e. the location of the target source $src_3$. The source $src_1$ and the source $src_2$, however, are located on one of the two beams 415, 425 only. It should be noted that both, the first and the second beamformers 410, 420 are adapted for directionally selective sound acquisition and their beams 415, 425 indicate the sound that is acquired by them, respectively. Thus, the first beam 425 of the first beamformer indicates a first recording characteristic of the first beamformer 410. The second beam 425 of the second beamformer 420 indicates a second recording characteristic of the second beamformer 420.

In the embodiment of FIG. 4*b*, the sources $src_1$ and $src_2$ represent undesired sources that interfere with the signal of the desired source $src_3$. However, sources $src_1$ and $src_2$ may also be considered as the independent ambience components picked up by the two beamformers. Ideally, the output of an apparatus according to an embodiment would only return $src_3$ while fully suppressing the undesired sources $src_1$ and $src_2$.

According to the embodiment of FIG. 4*b*, two or even more devices for directionally selective sound acquisition, e.g. directional microphones, microphone arrays and corresponding beamformers, are employed to achieve "remote spot microphone" functionality. Suitable beamformers may, for example, be microphone arrays or highly directional microphones, such as shot-gun microphones, and the output signals of, e.g., the microphone arrays or the highly directional microphones may be employed as beamformer audio signals. "Remote spot microphone" functionality is used to pick up only sound originating from a constrained area around the spot.

Figure 4C:
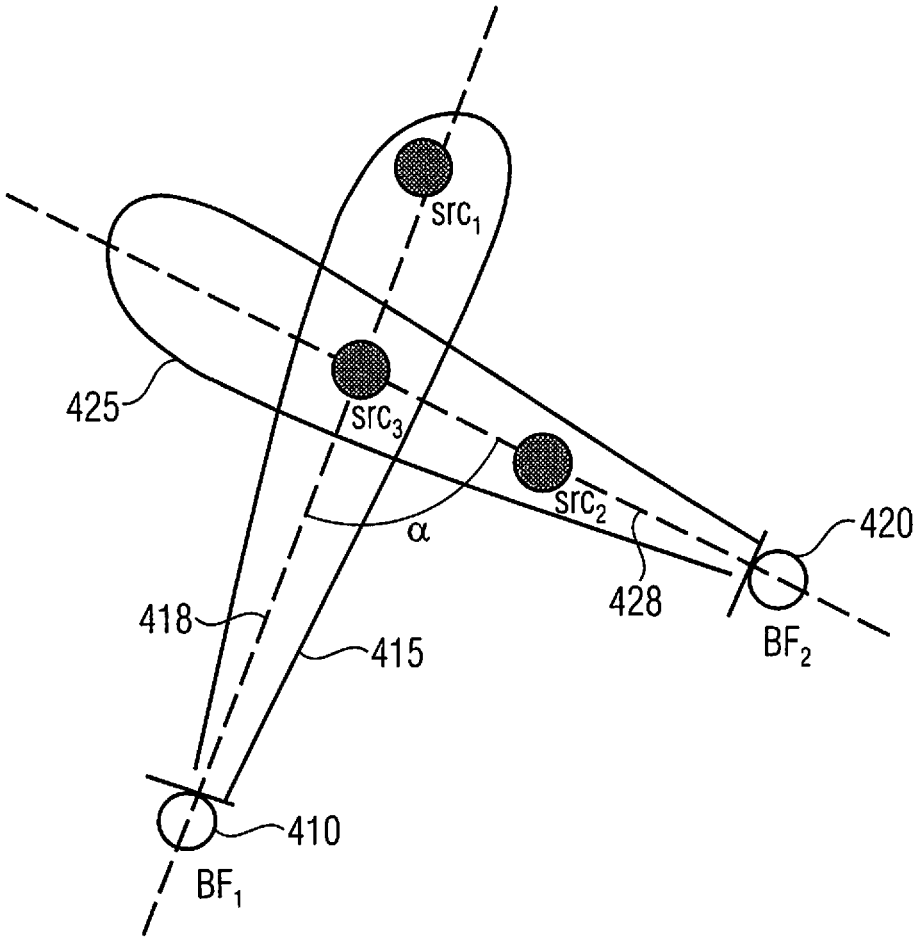
FIG. 4*c* illustrates the geometric setup of the two beamformers of FIG. 4*b* and three sound sources depicted in a more detailed illustration.

FIG. 4*c* illustrates this in more detail. According to an embodiment, the first beamformer 410 captures sound from a first direction. The second beamformer 420, which is located quite distantly from the first beamformer 410, captures sound from a second direction.

The first and the second beamformer 410, 420 are arranged such that they are directed to the target location 430. In advantageous embodiments, the beamformers 410, 420, e.g. two microphone arrays, are distant from each other and face the target spot from different directions. This is different to traditional microphone array processing, where only a single array is used and its different sensors are placed in close proximity of each other. The first major axis 418 of the first beamformer 410 and the second major axis 428 of the second beamformer 420 form two straight lines which are not arranged in parallel, but which instead intersect with an angle of intersection $\alpha$. The second beamformer 420 would be optimally positioned with respect to the first beamformer, when the angle of intersection is 90 degrees. In embodiments, the angle of intersection is at least 60 degrees.

The target spot or target area for sound capture is the intersection of both beams 415, 425. The signal from this area is derived by processing the output signals of the two beamformers 410, 420, such that an "acoustic intersection" is computed. This intersection can be considered as the signal part that is common/coherent between the two individual beamformer output signals.

Such a concept exploits both the individual directionality of the beamformers and the coherence between the beamformer output signals. This is different to common microphone array processing, where only a single array is used and its different sensors are placed in close proximity of each other.

By this, emitted sound is captured/acquired from a specific target location. This is in contrast to approaches which use distributed microphones for estimating the position of sound sources, but which do not aim at an enhanced recording of the localized sound sources by considering the output of distant microphone arrays as proposed according to embodiments.

Besides using highly directional microphones, the concepts according to embodiments can be implemented with both classical beamformers and parametric spatial filters. If the beamformer introduces frequency-dependent amplitude and phase distortions, this should be known and taken into account for the computation of the "acoustic intersection".

In an embodiment, a device, e.g. a signal generator, computes an "acoustic intersection" component. An ideal device for computing the intersection would deliver full output, if a signal is present in both beamformer audio signals (e.g. the audio signals recorded by the first and the second beamformer) and it would deliver zero output, if a signal is present only in one or none of the two beamformer audio signals. A good suppression characteristics that also ensures a good performance of the device may, for example, be achieved, by determining the transfer gain of a signal only present in one beamformer audio signal and by setting it into relation to the transfer gain for a signal present in both beamformer audio signals.

The two beamformer audio signals $s_1$ and $s_2$ may be considered as a superposition of a filtered, delayed and/or scaled common target signal s and individual noise/interferer signals, $n_1$ and $n_2$, such that $$s_1=f_1(s)+n_1$$

and $$s_2=f_2(s)+n_2$$

where $f_1(x)$ and $f_2(x)$ are the individual filtering, delay and/or scaling functions present for the two signals. Thus, the task is to estimate s from $s_1=f_1(s)+n_1$ and $s_2=f_2(s)+n_2$. To avoid ambiguities, $f_2(x)$ can be set to identity without loss in generality.

The "intersection component" may be implemented, in different ways.

According to an embodiment, the common part between the two signals is computed using filters, e.g. classic adaptive LMS (Least Mean Square) filters, as they are common for acoustic echo cancellation.

Figure 5:
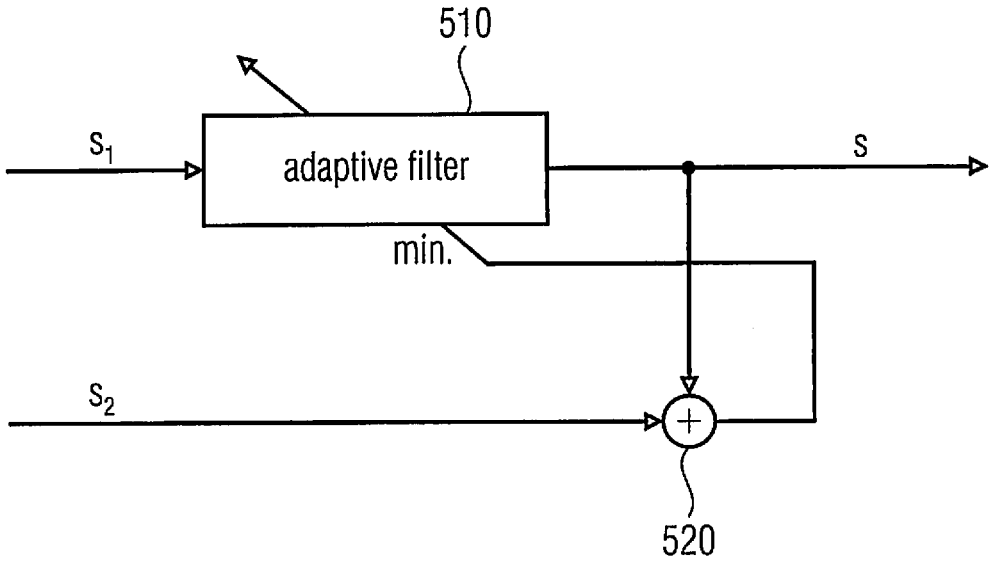
FIG. 5 depicts a signal generator according to an embodiment.

FIG. 5 illustrates a signal generator according to an embodiment, wherein a common signal is computed from signals $s_1$ and $s_2$ using an adaptive filter 510. The signal generator of FIG. 5 receives the first beamformer audio signal $s_1$ and the second beamformer audio signal $s_2$ and generates the audio output signal based on the first and the second beamformer audio signal $s_1$ and $s_2$.

The signal generator of FIG. 5 comprises an adaptive filter 510. A classic minimum mean square error adaption/optimization processing scheme, as known from acoustic echo cancellation, is realized by the adaptive filter 510. The adaptive filter 510 receives a first beamformer audio signal $s_1$ and filters the first beamformer audio signal $s_1$ to generate a filtered first beamformer audio signal s as audio output signal. (Another suitable notation for s would be $\tilde{s}$, however, for better readability, the time-domain audio output signal will be referred to as "s" in the following). Filtering of the first beamformer audio signal $s_1$ is conducted based on adjustable filter coefficients of the adaptive filter 510.

The signal generator of FIG. 5 outputs the filtered first beamformer audio signal s. Moreover, the filtered beamformer audio output signal s is also fed into a difference calculator 520. The difference calculator 520 also receives the second beamformer audio signal and calculates the difference between the filtered first beamformer audio signal s and the second beamformer audio signal $s_2$.

The signal generator is adapted to adjust the filter coefficients of the adaptive filter 510 such that the difference between the filtered version of $s_1$ (=s) and $s_2$ is minimized. Thus, the signal s, i.e. the filtered version of $s_1$, can be considered as representing the desired coherent output signal. Thus, the signal s, i.e. the filtered version of $s_1$ represents the desired coherent output signal.

In another embodiment, the common part between the two signals is extracted based on a coherence metric between the two signals, see, for example, the coherence metrics described in

[Fa03] C. Faller and F. Baumgarte, "Binaural Cue Coding—Part II: Schemes and applications," IEEE Trans. on Speech and Audio Proc., vol. 11, no. 6, November 2003.

See also, the coherence metrics described in [Fa06] and [Her08].

A coherent part of two signals can be extracted from signals being represented in a time domain, but also, and advantageously, from signals being represented in a spectral domain, e.g. a time/frequency domain.

Figure 6:
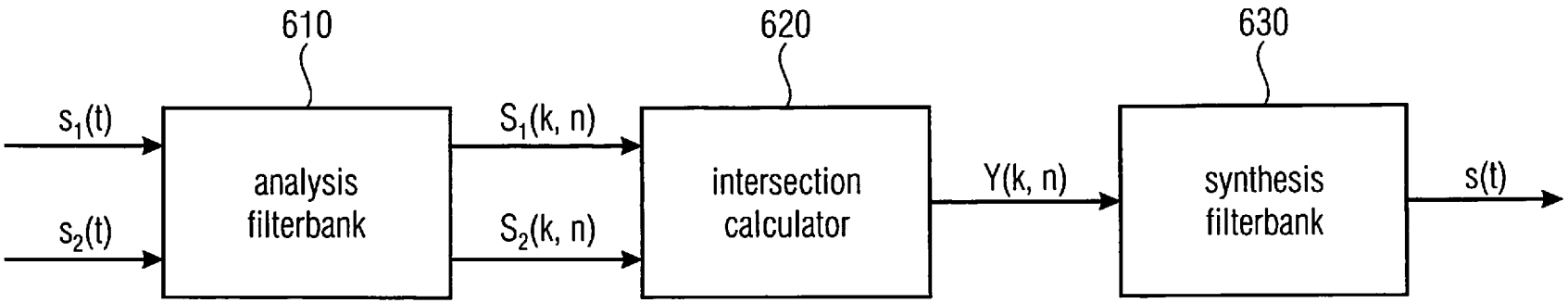
FIG. 6 illustrates a signal generator according to another embodiment.

FIG. 6 illustrates a signal generator according to an embodiment. The signal generator comprises an analysis filterbank 610. The analysis filterbank 610 receives a first beamformer audio signal $s_1(t)$ and a second beamformer audio signal $s_2(t)$. The first and the second beamformer audio signal $s_1(t)$, $s_2(t)$ are represented in a time domain; t specifies the number of the time sample of the respective beamformer audio signal. The analysis filterbank 610 is adapted to transform the first and the second beamformer audio signal $s_1(t)$, $s_2(t)$ from a time domain into a spectral domain, e.g. a time-frequency domain, to obtain a first $S_1(k, n)$ and a second $S_2(k, n)$ spectral-domain beamformer audio signal. In $S_1(k, n)$ and $S_2(k, n)$, k specifies the frequency index and n specifies the time index of the respective beamformer audio signal. The analysis filterbank may be any kind of analysis filterbank, such as Short-Time Fourier Transform (STFT) analysis filterbanks, polyphase filterbanks, Quadrature Mirror Filter (QMF) filterbanks, but also filterbanks like Discrete Fourier Transform (DFT), Discrete Cosine Transform (DCT) and the Modified Discrete Cosine Transform (MDCT) analysis filterbanks. By obtaining a spectral-domain first and second beamformer audio signal $S_1$ and $S_2$, the characteristics of the beamformer audio signals $S_1$ and $S_2$ can be analyzed for each time frame and for each of several frequency bands.

Moreover, the signal generator comprises an intersection calculator 620 for generating an audio output signal in the spectral domain.

Furthermore, the signal generator comprises a synthesis filterbank 630 for transforming the generated audio output signal from a spectral domain to a time domain. The synthesis filterbank 630 may, for example, comprise Short-Time Fourier Transform (STFT) synthesis filterbanks, polyphase synthesis filterbanks, Quadrature Mirror Filter (QMF) synthesis filterbanks, but also synthesis filterbanks like Discrete Fourier Transform (DFT), Discrete Cosine Transform (DCT) and the Modified Discrete Cosine Transform (MDCT) synthesis filterbanks.

In the following, possible ways of computing the audio output signal, e.g. by extracting a coherence, are explained. The intersection calculator 620 of FIG. 6 may be adapted to compute the audio output signal in the spectral domain according to one or more of these ways.

The coherence, as extracted is a measure of the common coherent content while compensating for scaling and phase shift operations. See, for example:

[Fa06] C. Faller, "Parametric Multichannel Audio Coding: Synthesis of Coherence Cues," IEEE Trans. on Speech and Audio Proc., vol. 14, no. 1, January 2006;

[Her08] J. Herre, K. Kjörling, J. Breebaart, C. Faller, S. Disch, H. Purnhagen, J. Koppens, J. Hilpert, J. Rödén. W. Oomen, K. Linzmeier, K. S. Chong: "MPEG Surround—The ISO/MPEG Standard for Efficient and Compatible Multichannel Audio Coding", Journal of the AES, Vol. 56, No. 11, November 2008, pp. 932-955

One possibility to generate an estimate of the coherent signal part of the first and the second beamformer audio signal is to apply the cross-factors to one of the two signals. The cross-factors may be time-averaged. Here, it is assumed, that the relative delay between the first and the second beamformer audio signal is limited, such that it is substantially smaller than the filterbank window size.

In the following, embodiments of calculating the audio output signal in the spectral domain by extracting the common signal part and by employing the correlation based approach based on an explicit calculation of a measure of coherence is explained in detail.

The signals $S_1(k,n)$ and $S_2(k,n)$ denote spectral-domain representations of the beamformer audio signals where k is a frequency index and n is a time index. For each particular time-frequency tile (k,n) specified by a particular frequency index k and a particular time index n, a coefficient exists for each of the signals $S_1(k,n)$ and $S_2(k,n)$. From the two spectral-domain beamformer audio signals $S_1(k,n)$, $S_2(k,n)$, the intersection component energy is computed. This intersection component energy may be computed by e.g., determining the magnitude of the cross-spectral density (CSD) $C_{12}(k,n)$ of $S_1(k,n)$ and $S_2(k,n)$:

$$C_{12}(k,n)=|E\{S_1(k,n)\cdot S^*_2(k,n)\}|$$

Here, the superscript * denotes the conjugate of a complex number and E{ } represents mathematical expectation. In practice, the expectation operator is replaced, e.g., by temporal or frequency smoothing of the term $S_1(k,n)\cdot S^*_2(k,n)$, depending on the time/frequency resolution of the filterbank employed.

The power spectral density (PSD) $P_1(k,n)$ of the first beamformer audio signal $S_1(k,n)$ and the power spectral density $P_2(k,n)$ of the second beamformer audio signal $S_2(k,n)$ may be computed according to the formulae:

$$P_1(k,n)=E\{|S_1(k,n)|^2\}$$

$$P_2(k,n)=E\{|S_2(k,n)|^2\}.$$

In the following, embodiments for practical implementations of the computation of the acoustic intersection Y(k,n) from the two beamformer audio signals are presented.

A first way to obtain an output signal is based on modifying the first beamformer audio signal $S_1(k,n)$:

$$Y_1(k, n) = S_1(k, n)\cdot G_1(k, n), \quad \text{with } G_1(k, n) = \sqrt{\frac{C_{12}(k, n)}{P_1(k, n)}}. \tag{1}$$

Similarly, an alternative output signal can be derived from the second beamformer audio signal $S_2(k,n)$:

$$Y_2(k, n) = S_2(k, n)\cdot G_2(k, n), \quad \text{with } G_2(k, n) = \sqrt{\frac{C_{12}(k, n)}{P_2(k, n)}}. \tag{2}$$

For determining the output signal, it may be useful to limit the maximum value of the gain functions $G_1(k,n)$ and $G_2(k,n)$ to a certain threshold value, e.g. to one.

Figure 7:
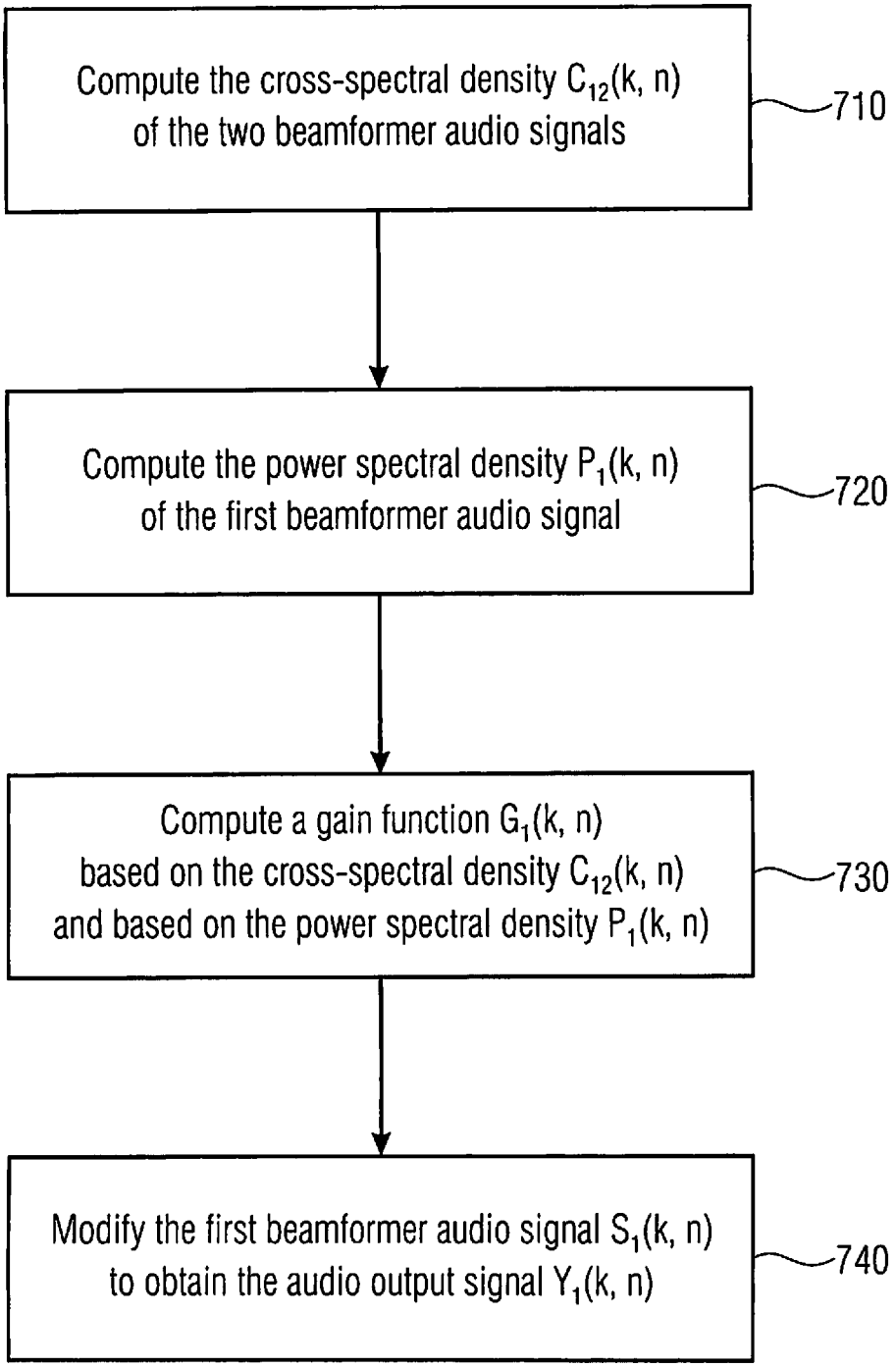
FIG. 7 is a flow chart illustrating the generation of an audio output signal based on a cross-spectral density and on a power spectral density according to an embodiment.

FIG. 7 is a flow chart illustrating the generation of an audio output signal based on a cross spectral density and on a power spectral density according to an embodiment.

In step 710 a cross-spectral density $C_{12}(k, n)$ of the first and the second beamformer audio signal is computed. For example, the above-described formula $C_{12}(k,n)=|E\{S_1(k,n)\cdot S^*_2(k,n)\}|$ may be applied.

In step 720, the power spectral density $P_1(k, n)$ of the first beamformer audio signal is computed. Alternatively, the power spectral density of the second beamformer audio signal may be used as well.

Subsequently, in step 730, a gain function G1(*k, n*) is computed based on the cross-spectral density calculated in step 710 and the power spectral density calculated in step 720.

Finally, in step 740, the first beamformer audio signal $S_1(k, n)$ is modified to obtain desired the audio output signal $Y_1(k, n)$. If the power spectral density of the second beamformer audio signal has been calculated in step 720, then, the second beamformer audio signal $S_2(k, n)$ may be modified to obtain the desired audio output signal.

Since both implementations have a single energy term in the denominator, which can become small depending on the location of the active sound source with respect to the two beams, it is advantageous to use a gain that represents the ratio between the sound energy corresponding to the acoustic intersection and the overall or mean sound energy picked up by the beamformers. An output signal may be obtained by applying the formula $$Y_3(k, n) = S_1 \cdot G_{34}(k, n), \quad \text{with } G_{34}(k, n) = \sqrt{\frac{C_{12}(k, n)}{0.5(P_1(k, n) + P_2(k, n))}}, \tag{3}$$

or by applying the formula:

$$Y_4(k, n) = S_2 \cdot G_{34}(k, n), \quad \text{with } G_{34}(k, n) = \sqrt{\frac{C_{12}(k, n)}{0.5(P_1(k, n) + P_2(k, n))}}. \tag{4}$$

In both examples described above, the gain functions will take small values in case the recorded sound in the beamformer audio signals does not comprise signal components of the acoustic intersection. On the other hand, gain values close to one are obtained if the beamformer audio signals correspond to the desired acoustic intersection.

Furthermore, in order to make sure that only components appear in the audio output signal that correspond to the acoustic intersection (despite of the limited directivity of the used beamformers) it may be advisable to compute the final output signal as the smaller signal (by energy) of $Y_1$ and $Y_2$ (or $Y_3$ and $Y_4$), respectively. In an embodiment, the signal $Y_1$ or $Y_2$ of the two signals $Y_1$, $Y_2$ is considered as the smaller signal, that has the smaller average energy. In another embodiment, the signal $Y_3$ or $Y_4$ is considered as the smaller signal of both signals $Y_3$, $Y_4$, that has the smaller average energy.

Also, other ways of calculating audio output signals exist that, unlike described with respect to the previous embodiments, make use of both the first and the second beamformer audio signals $S_1$ and $S_2$ (as opposed to only using their powers) by combining them into a single signal which is subsequently weighted using one of the described gain functions. For example, the first and the second beamformer audio signal $S_1$ and $S_2$ may be added and the resulting sum signal may subsequently be weighted using one of the above-described gain functions.

The spectral-domain audio output signal S may be converted back from a time/frequency representation to a time signal by using a synthesis (inverse) filterbank.

In another embodiment, the common part between the two signals is extracted by processing the magnitude spectra of a combined signal (e.g. a sum signal), for example, such that it has the intersection (e.g. minimum) PSD (Power Spectral Density) of both (normalized) beamformer signals. The input signals may be analyzed in a time/frequency selective fashion, as described before, and an idealized assumption is made that the two noise signals are sparse and disjoint, i.e. do not appear at the same time/frequency tile. In this case, a simple solution would be to limit the Power Spectral Density (PSD) value of one of the signals to the value of the other signal after some suitable re-normalization/alignment procedure. It may be assumed that the relative delay between the two signals is limited such that it is substantially smaller than the filterbank window size.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

A signal generated according to the above-described embodiments can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[BS01] J. Bitzer, K. U. Simmer: "Superdirective microphone arrays" in M. Brandstein, D. Ward (eds.): "Microphone Arrays—Signal Processing Techniques and Applications", Chapter 2, Springer Berlin, 2001, ISBN: 978-3-540-41953-2

[BW01] M. Brandstein, D. Ward: "Microphone Arrays—Signal Processing Techniques and Applications", Springer Berlin, 2001, ISBN: 978-3-540-41953-2

[CBH06] J. Chen, J. Benesty, Y. Huang: "Time Delay Estimation in Room Acoustic Environments An Overview", EURASIP Journal on Applied Signal Processing, Article ID 26503, Volume 2006 (2006)

[Pul06] Pulkki, V., "Directional audio coding in spatial sound reproduction and stereo upmixing," in Proceedings of The AES 28th International Conference, pp. 251-258, Piteå, Sweden, Jun. 30-Jul. 2, 2006.

[DiFi2009] M. Kallinger, G. Del Galdo, F. Küch, D. Mahne, and R. Schultz-Amling, "Spatial Filtering using Directional Audio Coding Parameters," in Proc. IEEE Int. Conf. on Acoustics, Speech, and Signal Processing (ICASSP), April 2009.

[Ea01] Eargle J. "The Microphone Book" Focal press 2001.

[Elk00] G. W. Elko: "Superdirectional microphone arrays" in S. G. Gay, J. Benesty (eds.): "Acoustic Signal Processing for Telecommunication", Chapter 10, Kluwer Academic Press, 2000, ISBN: 978-0792378143

[Fa03] C. Faller and F. Baumgarte, "Binaural Cue Coding—Part II: Schemes and applications," IEEE Trans. on Speech and Audio Proc., vol. 11, no. 6, November 2003

[Fa06] C. Faller, "Parametric Multichannel Audio Coding: Synthesis of Coherence Cues," IEEE Trans. on Speech and Audio Proc., vol. 14, no. 1, January 2006

[Fal08] C. Faller: "Obtaining a Highly Directive Center Channel from Coincident Stereo Microphone Signals", Proc. 124th AES convention, Amsterdam, The Netherlands, 2008, Preprint 7380.

[Her08] J. Herre, K. Kjörling, J. Breebaart, C. Faller, S. Disch, H. Purnhagen, J. Koppens, J. Hilpert, J. Rödén. W. Oomen, K. Linzmeier, K. S. Chong: "MPEG Surround—The ISO/MPEG Standard for Efficient and Compatible Multichannel Audio Coding", Journal of the AES, Vol. 56, No. 11, November 2008, pp. 932-955

[SBM01] K. U. Simmer, J. Bitzer, and C. Marro: "Post-Filtering Techniques" in M. Brandstein, D. Ward (eds.): "Microphone Arrays—Signal Processing Techniques and Applications", Chapter 3, Springer Berlin, 2001, ISBN: 978-3-540-41953-2

[Veen88] B. D. V. Veen and K. M. Buckley. "Beamforming: A versatile approach to spatial filtering". IEEE ASSP Magazine, pages 4-24, April 1988.

[Vil06] L. Villemoes, J. Herre, J. Breebaart, G. Hotho, S. Disch, H. Purnhagen, and K. Kjörling, "MPEG Surround: The Forthcoming ISO Standard for Spatial Audio Coding," in AES 28th International Conference, Pitea, Sweden, June 2006.

The invention claimed is:

1. An apparatus for capturing audio information from a target location, comprising:

a first beamformer being arranged in a recording environment and comprising a first recording characteristic, a second beamformer being arranged in the recording environment and comprising a second recording characteristic, and a signal generator, wherein the first beamformer is configured for recording a first beamformer audio signal when the first beamformer is directed towards the target location with respect to the first recording characteristic, and wherein the second beamformer is configured for recording a second beamformer audio signal when the second beamformer is directed towards the target location with respect to the second recording characteristic, wherein the first beamformer and the second beamformer are arranged such that a first virtual straight line, being defined to pass through the first beamformer and the target location, and a second virtual straight line, being defined to pass through the second beamformer and the target location, are not parallel with respect to each other, and wherein the signal generator is configured to generate an audio output signal based on the first beamformer audio signal and on the second beamformer audio signal, so that the audio output signal comprises relatively more audio information from the target location compared to the audio information from the target location in the first and the second beamformer audio signal, wherein the signal generator comprises an intersection calculator for generating the audio output signal in the spectral domain based on the first and second beamformer audio signal, and wherein the intersection calculator is configured to compute the audio output signal in the spectral domain by calculating a cross-spectral density of the first and the second beamformer audio signal, and by calculating a power spectral density of the first or the second beamformer audio signal.

2. The apparatus according to claim 1, wherein the first virtual straight line and the second virtual straight line are arranged such that they intersect in the target location with an angle of intersection such that the angle of intersection is between 30 degrees and 150 degrees.

3. The apparatus according to claim 2, wherein the first virtual straight line and the second virtual straight line are arranged such that they intersect in the target location such that the angle of intersection is approximately 90 degrees.

4. The apparatus according to claim 1, wherein the signal generator comprises an adaptive filter comprising a plurality of filter coefficients, wherein the adaptive filter is arranged to receive the first beamformer audio signal, wherein the adaptive filter is adapted to modify the first beamformer audio signal depending on the filter coefficients to achieve a filtered first beamformer audio signal as audio output signal, and wherein the signal generator is configured to adjust the filter coefficients of the adaptive filter depending on the filtered first beamformer audio signal and on the second beamformer audio signal.

5. The apparatus according to claim 4, wherein the signal generator is configured to adjust the filter coefficients such that the difference between the filtered first audio signal and the second beamformer audio signal is minimized.

6. The apparatus according to claim 1, wherein the signal generator further comprises:

an analysis filterbank for transforming the first and the second beamformer audio signals from a time domain to a spectral domain, and a synthesis filterbank for transforming the audio output signal from a spectral domain to a time domain, wherein the intersection calculator is configured to calculate the audio output signal in the spectral domain based on the first beamformer audio signal being represented in the spectral domain and on the second beamformer audio signal being represented in the spectral domain, wherein the calculation is carried out separately in several frequency bands.

7. The apparatus according to claim 1, wherein the intersection calculator is configured to compute the audio output signal in the spectral domain by employing the formula $$Y_1(k, n) = S_1(k, n) \cdot G_1(k, n),$$

$$\text{with } G_1(k, n) = \sqrt{\frac{C_{12}(k, n)}{P_1(k, n)}}$$

wherein $Y_1(k, n)$ is the audio output signal in the spectral domain, wherein $S_1(k, n)$ is the first beamformer audio signal, wherein $C_{12}(k, n)$ is a cross-spectral density of the first and the second beamformer audio signal, and wherein $P_1(k, n)$ is a power spectral density of the first beamformer audio signal, or by employing the formula $$Y_2(k, n) = S_2(k, n) \cdot G_2(k, n),$$

$$\text{with } G_2(k, n) = \sqrt{\frac{C_{12}(k, n)}{P_2(k, n)}}$$

wherein $Y_2(k, n)$ is the audio output signal in the spectral domain, wherein $S_2(k, n)$ is the second beamformer audio signal, wherein $C_{12}(k, n)$ is a cross-spectral density of the first and the second beamformer audio signal, and wherein $P_2(k, n)$ is a power spectral density of the second beamformer audio signal.

8. The apparatus according to claim 1, wherein the intersection calculator is configured to compute the audio output signal in the spectral domain by employing the formula $$Y_3(k, n) = S_1 \cdot G_{34}(k, n),$$

$$\text{with } G_{34}(k, n) = \sqrt{\frac{C_{12}(k, n)}{0.5(P_1(k, n) + P_2(k, n))}}$$

wherein $Y_3(k, n)$ is the audio output signal in the spectral domain, wherein $S_1$ is the first beamformer audio signal, wherein $C_{12}(k, n)$ is a cross-spectral density of the first beamformer audio signal, wherein $P_1(k, n)$ is a power spectral density of the first beamformer audio signal, and wherein $P_2(k, n)$ is a power spectral density of the second beamformer audio signal, or by employing the formula $$Y_4(k, n) = S_2 \cdot G_{34}(k, n),$$

$$\text{with } G_{34}(k, n) = \sqrt{\frac{C_{12}(k, n)}{0.5(P_1(k, n) + P_2(k, n))}}$$

wherein $Y_4(k, n)$ is the audio output signal in the spectral domain, wherein $S_2$ is the second beamformer audio signal, wherein $C_{12}(k, n)$ is a cross-spectral density of the first and the second beamformer audio signal, wherein $P_1(k, n)$ is a power spectral density of the first beamformer audio signal, and wherein $P_2(k, n)$ is a power spectral density of the second beamformer audio signal.

9. The apparatus according to claim 7, wherein the intersection calculator is adapted to compute a first intermediate signal according to the formula $$Y_1(k, n) = S_1(k, n) \cdot G_2(k, n),$$

$$\text{with } G_1(k, n) = \sqrt{\frac{C_{12}(k, n)}{P_1(k, n)}},$$

and a second intermediate signal according to the formula $$Y_2(k, n) = S_2(k, n) \cdot G_2(k, n),$$

$$\text{with } G_2(k, n) = \sqrt{\frac{C_{12}(k, n)}{P_2(k, n)}}$$

and wherein the intersection calculator is adapted to select the smaller of the first and the second intermediate signal as the audio output signal, or wherein the intersection calculator is configured to a third intermediate signal according to the formula $$Y_3(k, n) = S_1 \cdot G_{34}(k, n),$$

$$\text{with } G_{34}(k, n) = \sqrt{\frac{C_{12}(k, n)}{0.5(P_1(k, n) + P_2(k, n))}}$$

and a fourth intermediate signal according to the formula $$Y_4(k, n) = S_2 \cdot G_{34}(k, n),$$

$$\text{with } G_{34}(k, n) = \sqrt{\frac{C_{12}(k, n)}{0.5(P_1(k, n) + P_2(k, n))}}$$

and wherein the intersection calculator is adapted to select the smaller of the third and the fourth intermediate signal as the audio output signal.

10. The apparatus according to claim 1, wherein the signal generator is adapted to generate the audio output signal by combining the first and the second beamformer audio signal to achieve a combined signal and by weighting the combined signal by a gain factor.

11. The apparatus according to claim 1, wherein the signal generator is adapted to generate the audio output signal by generating a combined signal such that the power spectral density value of the combined signal is equal to the minimum of the power spectral density value of the first and the second beamformer audio signal for each considered time-frequency tile.

12. A method for computing audio information from a target location, comprising:

recording a first beamformer audio signal by a first beamformer being arranged in a recording environment and comprising a first recording characteristic when the first beamformer is directed towards the target location with respect to the first recording characteristic, recording a second beamformer audio signal by a second beamformer being arranged in the recording environment and comprising a second recording characteristic when the second beamformer is directed towards the target location with respect to the second recording characteristic, generating an audio output signal based on the first beamformer audio signal and on the second beamformer audio signal so that the audio output signal comprises relatively more audio information from the target location compared to the audio information from the target location in the first and the second beamformer audio signal, wherein the first beamformer and the second beamformer are arranged such that a first virtual straight line, being defined to pass through the first beamformer and the target location and a second virtual straight line, being defined to pass through the second beamformer and the target location, are not parallel with respect to each other, wherein the audio output signal is generated in the spectral domain by calculating the first and second beamformer audio signal, and wherein the audio output signal is computed in the spectral domain by calculating a cross-spectral density of the first and the second beamformer audio signal, and by calculating a power spectral density of the first or the second beamformer audio signal.

13. A computer program, on a non-transitory, computer-readable medium, for implementing the method for computing audio information from a target location, said method comprising:

recording a first beamformer audio signal by a first beamformer being arranged in a recording environment and comprising a first recording characteristic when the first beamformer is directed towards the target location with respect to the first recording characteristic, recording a second beamformer audio signal by a second beamformer being arranged in the recording environment and comprising a second recording characteristic when the second beamformer is directed towards the target location with respect to the second recording characteristic, generating an audio output signal based on the first beamformer audio signal and on the second beamformer audio signal so that the audio output signal comprises relatively more audio information from the target location compared to the audio information from the target location in the first and the second beamformer audio signal, wherein the first beamformer and the second beamformer are arranged such that a first virtual straight line, being defined to pass through the first beamformer and the target location and a second virtual straight line, being defined to pass through the second beamformer and the target location, are not parallel with respect to each other, wherein the audio output signal is generated in the spectral domain by calculating the first and second beamformer audio signal, and wherein the audio output signal is computed in the spectral domain by calculating a cross-spectral density of the first and the second beamformer audio signal, and by calculating a power spectral density of the first or the second beamformer audio signal, when the computer program is executed by a computer or processor.

* * * * *